US012612775B2

(12) United States Patent
Shinohara et al.

(10) Patent No.: US 12,612,775 B2
(45) Date of Patent: Apr. 28, 2026

(54) WALL-MOUNTED FLUSH TOILET

(71) Applicant: TOTO LTD., Kitakyushu (JP)

(72) Inventors: Yuuki Shinohara, Kitakyushu (JP); Hiroshi Hashimoto, Kitakyushu (JP)

(73) Assignee: Toto Ltd., Fukuoka (JP)

( * ) Notice: Subject to any disclaimer, the term of this patent is extended or adjusted under 35 U.S.C. 154(b) by 148 days.

(21) Appl. No.: 18/532,850

(22) Filed: Dec. 7, 2023

(65) Prior Publication Data

US 2024/0287782 A1 Aug. 29, 2024

(30) Foreign Application Priority Data

Feb. 28, 2023 (JP) ..... 2023-029900

(51) Int. Cl.
*E03D 11/14* (2006.01)

(52) U.S. Cl.
CPC ..... *E03D 11/146* (2013.01)

(58) Field of Classification Search
CPC ..... E03D 11/146
USPC ..... 4/252.2
See application file for complete search history.

(56) References Cited

U.S. PATENT DOCUMENTS

| | | | | |
|---|---|---|---|---|
| 8,881,318 | B2 * | 11/2014 | Stammel | E03D 11/14 4/252.2 |
| 2011/0099704 | A1 * | 5/2011 | Kramer | E03D 11/02 4/420 |
| 2021/0095456 | A1 | 4/2021 | Chen et al. | |

FOREIGN PATENT DOCUMENTS

| | | | |
|---|---|---|---|
| CN | 207017385 | U | 2/2018 |
| CN | 109518780 | A | 3/2019 |
| CN | 213233669 | U | 5/2021 |
| EP | 3498926 | A1 | 6/2019 |
| JP | 02011880 | U | 1/1990 |
| JP | 2004116249 | A | 4/2004 |
| JP | 2021095698 | A | 6/2021 |
| JP | 2021145849 | A | 9/2021 |
| JP | 2022-48336 | A | 3/2022 |
| WO | 2014209242 | A1 | 12/2014 |

* cited by examiner

*Primary Examiner* — Lauren A Crane
(74) *Attorney, Agent, or Firm* — BakerHostetler

(57) ABSTRACT

A wall-mounted flush toilet includes a ceramic toilet main body including a bowl configured to receive waste and a discharge trap having an inlet connected to a lower part of the bowl and configured to discharge waste from within the bowl, the ceramic toilet main body further includes a skirt that covers outer shells of the bowl and the discharge trap from sides of the outer shells and a rear end formed rearward of the skirt and configured to be fixed to a wall, and the rear end includes a firing pedestal that functions as a pedestal grounded during a firing process in a ceramic molding process.

7 Claims, 7 Drawing Sheets

DURING FIRING PROCESS

SINGLE THICKNESS

WALL-MOUNTED FLUSH TOILET

This application claims benefit of priority to Japanese Patent Application No. 2023-029900, filed on Feb. 28, 2023, the entire content of which is incorporated herein by reference.

BACKGROUND OF THE INVENTION

Field of the Invention

The present invention relates to a flush toilet, in particular to a wall-mounted flush toilet fixed to a wall.

Description of the Related Art

Conventionally, as a flush toilet fixed to a wall (so-called, "wall-mounted flush toilet"), for example, what is described in Patent Document 1 (Japanese Patent Laid-Open No. 2022-48336) is known. In such a conventional wall-mounted flush toilet described in Patent Document 1, a ceramic toilet main body includes a bowl that receives waste, a discharge trap that discharges waste from within the bowl, and a skirt that covers outer shells of the bowl and the discharge trap from sides of the outer shells, and a rear end of the toilet main body is fixed to a wall behind the toilet main body.

For the conventional wall-mounted flush toilet described above, a manufacturing process of a ceramic toilet main body includes a process of pouring slurry into a molding mold and demolding to mold a ceramic molded body, a process (drying process) of drying this molded body, a process (glazing process) of glazing the molded body, and then a process (firing process) of heating (firing) the molded body within a kiln. Furthermore, in the firing process during manufacturing of the conventional wall-mounted flush toilet described above, firing is performed with a posture of the molded body for the toilet main body being placed on a shelf surface or floor surface within the kiln.

In the conventional wall-mounted flush toilet described above, product specifications of the toilet main body include, for example, a specification of the toilet main body including a discharge trap having a lowermost end part projected downward from a lowermost end part of a skirt. During the firing process, when disposing the molded body of the toilet main body of this specification on the shelf surface or floor surface within the kiln, there is a problem that it is difficult to stabilize the posture of the toilet main body having a lower end of the toilet main body located below. In order to solve such a problem, during the firing process, when the molded body of the toilet main body is disposed on the shelf surface or floor surface within the kiln with a posture of the toilet main body having a rear end located below, that is, a posture of the toilet main body with the front-rear direction of the toilet main body extending in the vertical direction, the wight of the entire molded body of the toilet main body concentrates on a ground contact surface between the rear end of the toilet main body and the shelf surface or floor surface within the kiln. Consequently, if a portion of the molded body of the toilet main body grounded during the firing process is deformed due to shrinkage or the like, the portion is dragged along the ground contact surface and more deformed, which causes a problem that dimensions of toilet main bodies noticeably vary and that, for example, outer shapes of the toilet main bodies are more likely to vary. Therefore, in the wall-mounted flush toilet, tasks to inhibit the outer shapes of toilet main body from being likely to vary and inhibit appearance of the flush toilet from being affected have been required to solve in recent years.

The present invention has been made to solve the above-described problems of conventional technologies and the tasks required to solve in recent years, and an object of the present invention is to provide a wall-mounted flush toilet capable of inhibiting outer shapes of toilet main bodies from being likely to vary and inhibiting appearance of the flush toilet from being affected.

SUMMARY OF THE INVENTION

In order to solve the above-described tasks, the present invention provides a wall-mounted flush toilet to be fixed to a wall and including a ceramic toilet main body including a bowl configured to receive waste and a discharge trap having an inlet connected to a lower part of the bowl and configured to discharge waste from within the bowl, in which the ceramic toilet main body further includes a skirt that at least partially covers outer shells of the bowl and the discharge trap from sides of the outer shells and a rear end formed rearward of the skirt and configured to be fixed to the wall, and the rear end includes a firing pedestal that functions as a pedestal grounded during a firing process in a ceramic molding process. In the present invention including this configuration, the rear end formed rearward of the skirt in the ceramic toilet main body includes the firing pedestal that functions as the pedestal grounded during the firing process in the ceramic molding process. Therefore, even if the firing pedestal grounded during the firing process is deformed due to shrinkage or the like, dragged along a ground contact surface, and further deformed to cause dimensional variation, the firing pedestal can absorb the dimensional variation in toilet main bodies. As compared with a toilet main body that does not include the firing pedestal in the rear end, a portion of the toilet main body that is likely to deform can be limited to the firing pedestal, and a portion other than the firing pedestal can be inhibited from being deformed. Therefore, it is possible to inhibit outer shapes of toilet main body from being likely to vary and inhibit appearance of the flush toilet from being affected.

In the present invention, preferably, the firing pedestal is disposed a predetermined distance or more inside an outer shell on each of left and right sides of the skirt in planar view of the toilet main body, the ceramic molding process includes a process of pouring slurry into a molding mold and then demolding to mold a hollow molded body, the molded body includes a first wall and a second wall that are formed on opposite sides of a hollow region of the molded body, and the predetermined distance is set to a dimension of a single thickness that is a thickness obtained by adding up a wall thickness of the first wall, a thickness of the hollow region, and a wall thickness of the second wall. In the present invention including this configuration, the firing pedestal is disposed the predetermined distance (dimension of the single thickness) or more inside the outer shell on each of the left and right sides of the skirt in the planar view of the toilet main body. Therefore, even if deformation occurs as much as the dimension of the single thickness due to shrinkage or the like in the firing process, the firing pedestal can sufficiently absorb the deformation. As compared with a toilet main body that does not include the firing pedestal, it is possible to effectively inhibit the outer shapes of toilet main bodies from being likely to vary, and it is therefore possible to effectively inhibit the appearance of the flush toilet from being affected.

In the present invention, preferably, the firing pedestal is formed such that at least a part of the firing pedestal has a dimension in a left-right direction equal to the dimension of the single thickness in the planar view of the toilet main body. In the present invention including this configuration, the firing pedestal is formed such that at least a part of the firing pedestal that is in contact with the ground contact surface during the firing process has the dimension in the left-right direction equal to the dimension of the single thickness in the planar view of the toilet main body, so that the entire firing pedestal can acquire sufficient strength.

In the present invention, preferably, the firing pedestal is formed in a dimension in a front-rear direction that is smaller than the dimension of the single thickness in the planar view of the toilet main body. In the present invention including this configuration, the firing pedestal is formed in the dimension in the front-rear direction that is smaller than the dimension of the single thickness in the planar view of the toilet main body. Thereby, a largely deformed portion of the firing pedestal that is in contact with the ground contact surface during the firing process can be reduced to a comparatively small dimension. Therefore, it is possible to inhibit the toilet main body from being affected by the deformation such as shrinkage or the like in the firing pedestal during the firing process.

In the present invention, preferably, the firing pedestal is formed to have a rear end formed in a flat surface. In the present invention including this configuration, the firing pedestal is formed to have the rear end formed in the flat surface, so that, when the firing pedestal is grounded during the firing process, the flat surface of the rear end of the firing pedestal can be grounded to stably support the weight of the entire toilet main body.

In the present invention, preferably, the firing pedestal includes a left firing pedestal part provided on a left side of the rear end of the toilet main body in the left-right direction, a right firing pedestal part provided on a right side of the rear end of the toilet main body in the left-right direction, and a connection part provided between the left firing pedestal part and the right firing pedestal part and connecting the left firing pedestal part and the right firing pedestal part, and the connection part includes a ground contact surface when the toilet main body is grounded during the firing process. In the present invention including this configuration, the connection part connecting the left firing pedestal part and the right firing pedestal part in the firing pedestal includes the ground contact surface when the toilet main body is grounded during the firing process. Thereby, when the firing pedestal is grounded during the firing process, the ground contact surface of the connection part of the firing pedestal can stably support the weight of the entire toilet main body, and the toilet main body can have strength further improved.

Advantageous Effects of Invention

According to the wall-mounted flush toilet of the present invention, it is possible to inhibit outer shapes of toilet main bodies from being likely to vary and inhibit the appearance from being affected.

DETAILED DESCRIPTION OF THE PREFERRED EMBODIMENT

Figure 1:
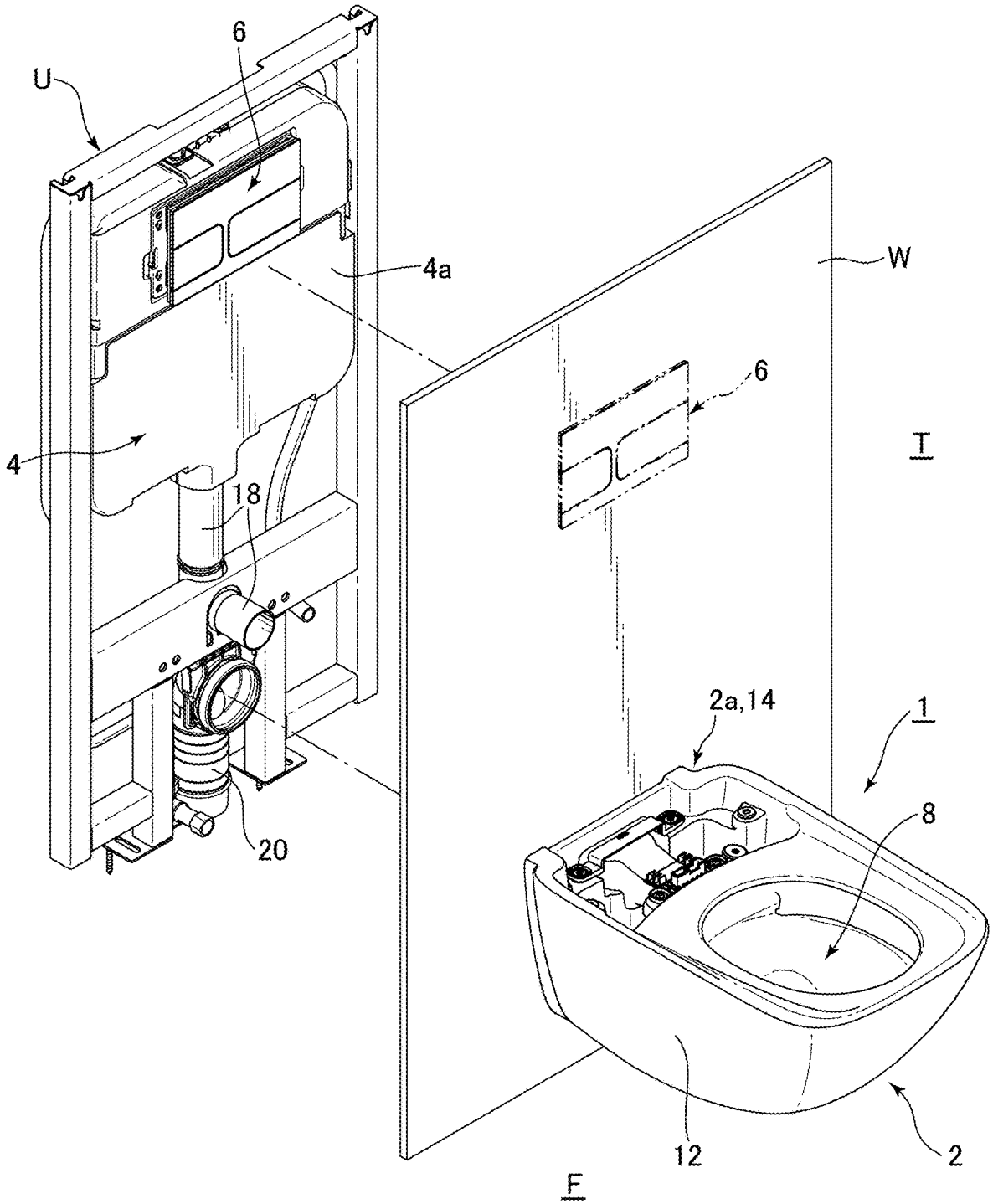
FIG. 1 is an exploded perspective view showing a state where a wall-mounted flush toilet according to one embodiment of the present invention is fixed to a wall.
Figure 2:
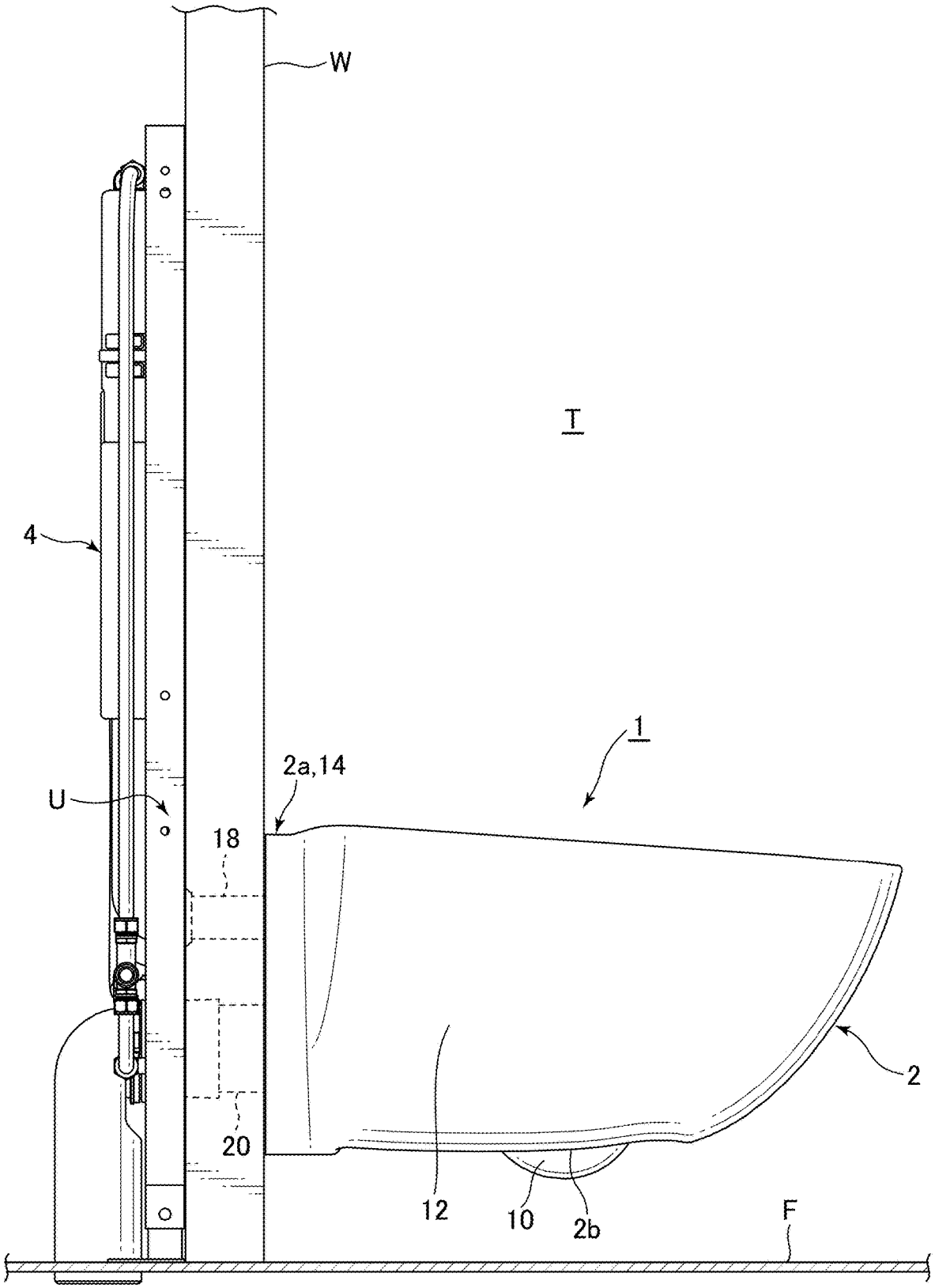
FIG. 2 is a left side view showing the state where the wall-mounted flush toilet according to the embodiment of the present invention is fixed to the wall.

Hereinafter, with reference to FIGS. 1 to 8, a wall-mounted flush toilet according to one embodiment of the present invention will be described. First, as shown in FIGS. 1 to 4, in a wall-mounted flush toilet 1 according to the embodiment of the present invention, a toilet main body 2 includes a rear end 2*a* fixed to a wall W, on a back side within a toilet room T, and the toilet main body 2 includes a lower end part 2*b* disposed above and spaced apart from a floor surface F. As shown in FIG. 1, the wall-mounted flush toilet 1 of the present embodiment more specifically includes a structure where the toilet main body 2 is fixed from a back side of the wall by a fixing unit U provided on a back surface side of the wall W (the back side of the wall). Further, on a fixing unit U side, a flush water supply device 4 being a water supply source that supplies flush water to the toilet main body 2 of the flush toilet 1, a flush operation device 6 that operates the flush water supply device 4 and others are provided, and these devices 4 and 6 include a structure of being concealed on the back side of the wall W. In the flush toilet 1 of the present embodiment, as the flush water supply device 4 that is the water supply source supplying flush water to the toilet main body 2, a form employing a so-called "gravity water supply type" of reservoir tank 4*a* that supplies the flush water reserved in a reservoir tank 4*a* to the toilet main body 2 by gravity is described, but as another form of water supply source, a so-called "tap water direct pressure type" of water supply device that directly supplies flush water to the toilet main body 2 by use of water supply pressure from water service may be employed. In addition, a "flush valve type" of water supply device, a "pump type" of water supply device that supplies flush water reserved in the reservoir tank by use of auxiliary pressure of a pump, or the like may be employed.

Next, as shown in FIGS. 1 to 4, the toilet main body 2 of the flush toilet 1 of the present embodiment is a ceramic toilet main body 2 formed of ceramic. Further, the ceramic toilet main body 2 includes a bowl 8 configured to receive waste and a discharge trap 10 including an inlet 10*a* connected to a lower part of the bowl 8 and configured to discharge waste from within the bowl 8. The ceramic toilet main body 2 includes a skirt 12 that covers outer shells of the bowl 8 and the discharge trap 10 from sides of the outer shells, and the rear end 2*a* formed rearward of the skirt 12 and configured to be fixed to the wall W. The skirt 12 is not limited to a form of so-called "full skirt type" that covers the entire circumference of the toilet main body 2, and may be in the form of, for example, a so-called "side pocket type" including an opening provided on a part of a side surface of the skirt 12. Alternatively, a part of the skirt 12 may be in the form of a panel member or the like that is detachably attached so as to cover the toilet main body 2 from outside. In short, the skirt 12 may at least partially cover the outer shells of the bowl 8 and the discharge trap 10 of the toilet main body 2 from the sides of the outer shells. The rear end 2*a* of the toilet main body 2 includes a firing pedestal 14 (described later in detail) that functions as a pedestal grounded during a firing process in a ceramic molding process.

Next, as shown in FIGS. 1 to 5, in the toilet main body 2 in a state where the ceramic toilet main body 2 is fixed to the wall W by the fixing unit U, an inlet 16*a* at an upstream end (rear end) of a main water conduit 16 formed upstream of the bowl 8 is connected to a water supply pipe 18 extending downstream of the reservoir tank 4*a* of the flush water supply device 4. In the toilet main body 2 in a state where the ceramic toilet main body 2 is fixed to the wall W by the fixing unit U, an exit 10*b* at a downstream end (rear end) of the discharge trap 10 is connected to a discharge pipe 20 extending upward from the floor surface F on the back side of the wall W and then bending and extending forward. Here, the wall-mounted flush toilet 1 of the present embodiment may be in the form of a so-called "wash-away type" of flush toilet that washes away waste from within the bowl 8 by use of water drop in the height direction of the bowl 8 within the toilet main body 2, a so-called "siphon type" of flush toilet that takes in waste from within the bowl 8 by use of siphon action to discharge the waste outward from the discharge trap 10, or another type of flush toilet.

Next, with reference to FIGS. 3 and 5 to 8, the firing pedestal 14 in the toilet main body 2 of the flush toilet 1 according to the present embodiment will be described in detail. First, a manufacturing process of the ceramic toilet main body 2 in the flush toilet 1 of the present embodiment will be schematically and briefly described. The manufacturing process of the ceramic toilet main body 2 includes, for example, a ceramic molding process of pouring slurry into a molding mold molded of gypsum, resin or the like to mold a shape of ceramic, a drying process of drying the ceramic molded in this molding process, a glazing process of glazing the dried ceramic, and a firing process of firing the glazed ceramic within a kiln.

The ceramic molding process of the ceramic toilet main body 2 includes, for example, a process (pouring process) of pouring slurry into a molding mold made of a gypsum mold or the like, a process (slurry removal process) of removing excess slurry from inside the molded body after depositing the slurry in the molding mold, a process (soil tightening process) of reducing water content of the molded body to improve shape retention and demoldability, and a process (demolding process) of demolding the molded body.

Figure 3:
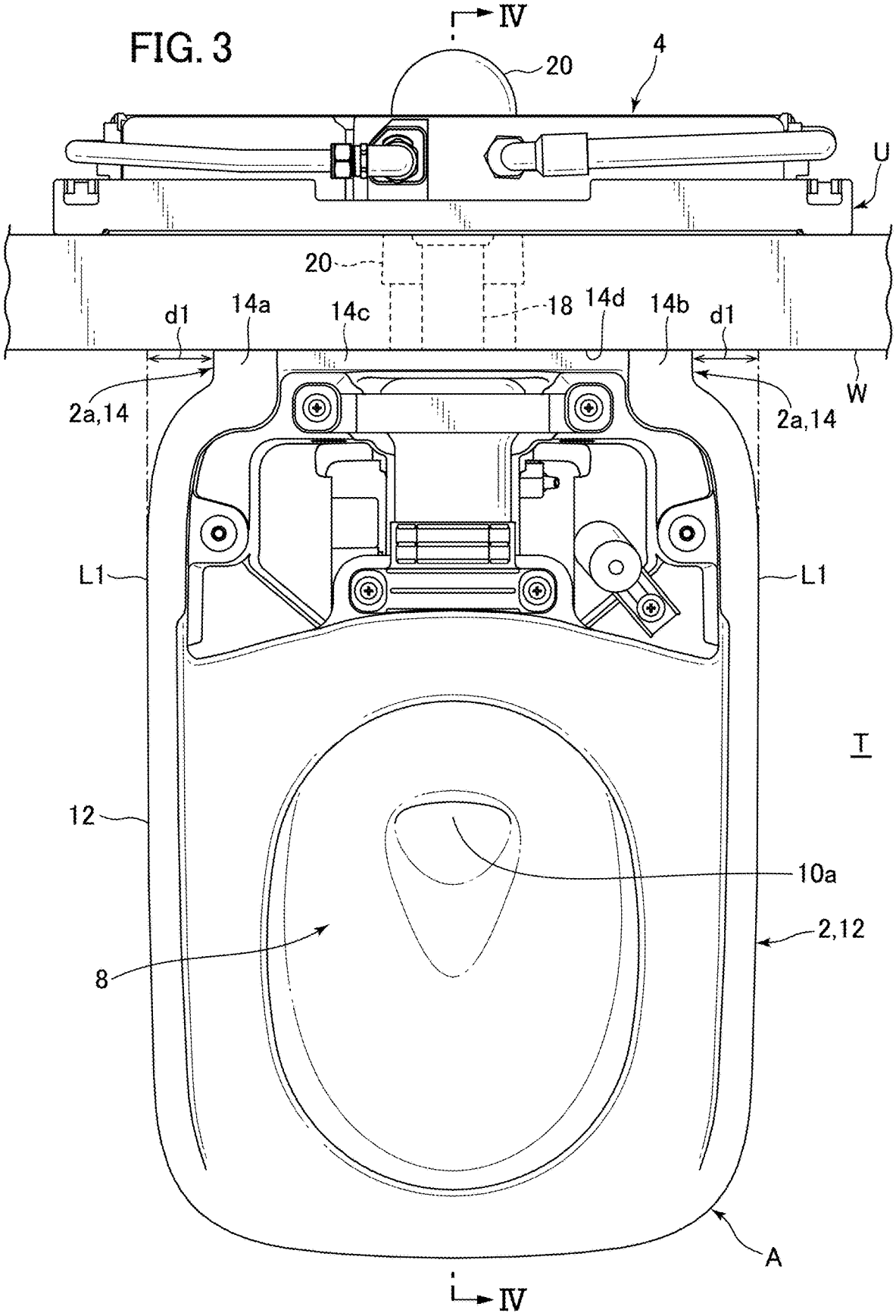
FIG. 3 is a plan view showing the state where the wall-mounted flush toilet according to the embodiment of the present invention is fixed to the wall.
Figure 4:
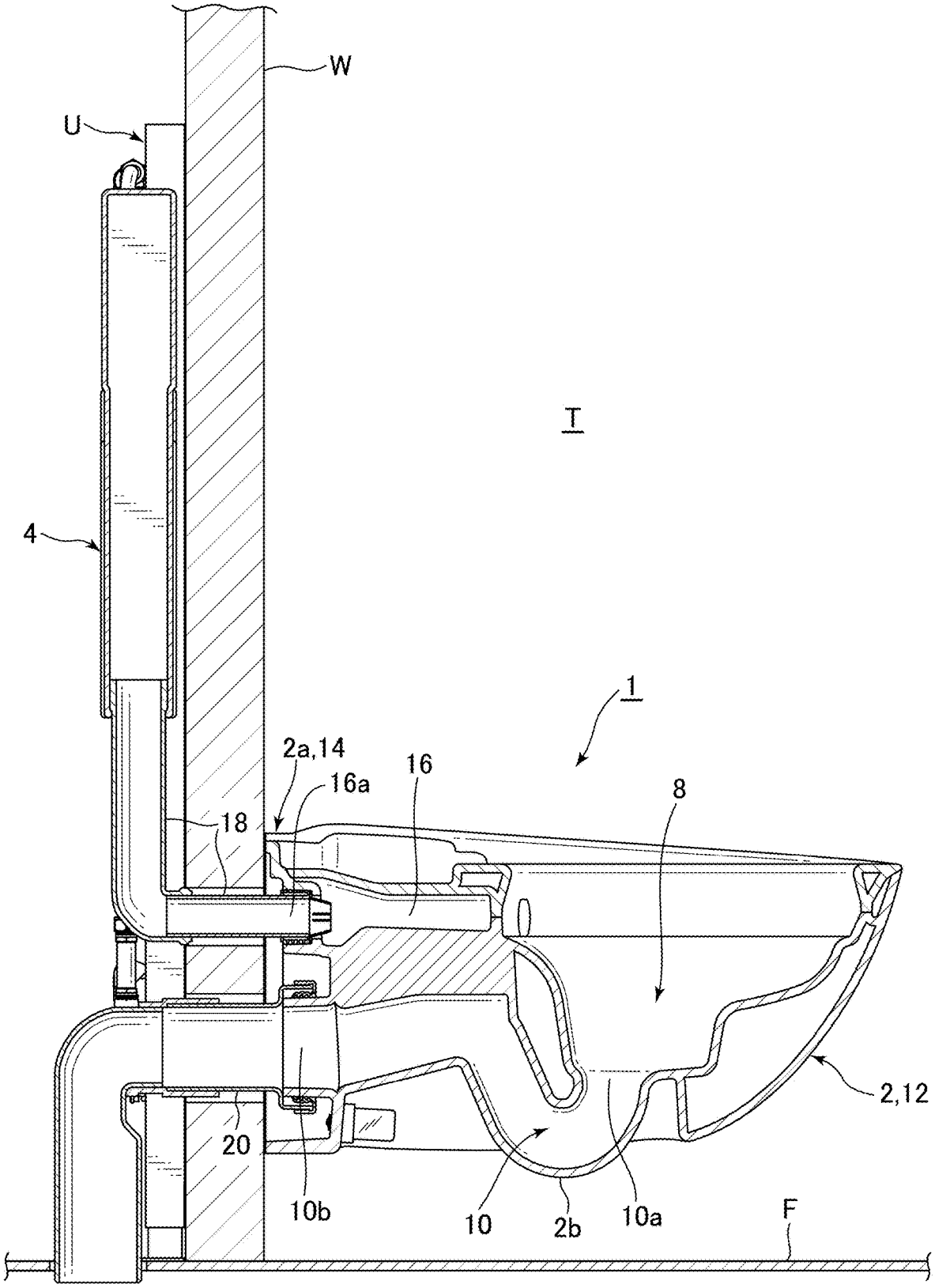
FIG. 4 is a cross-sectional view taken along the line IV-IV of FIG. 3.
Figure 5:
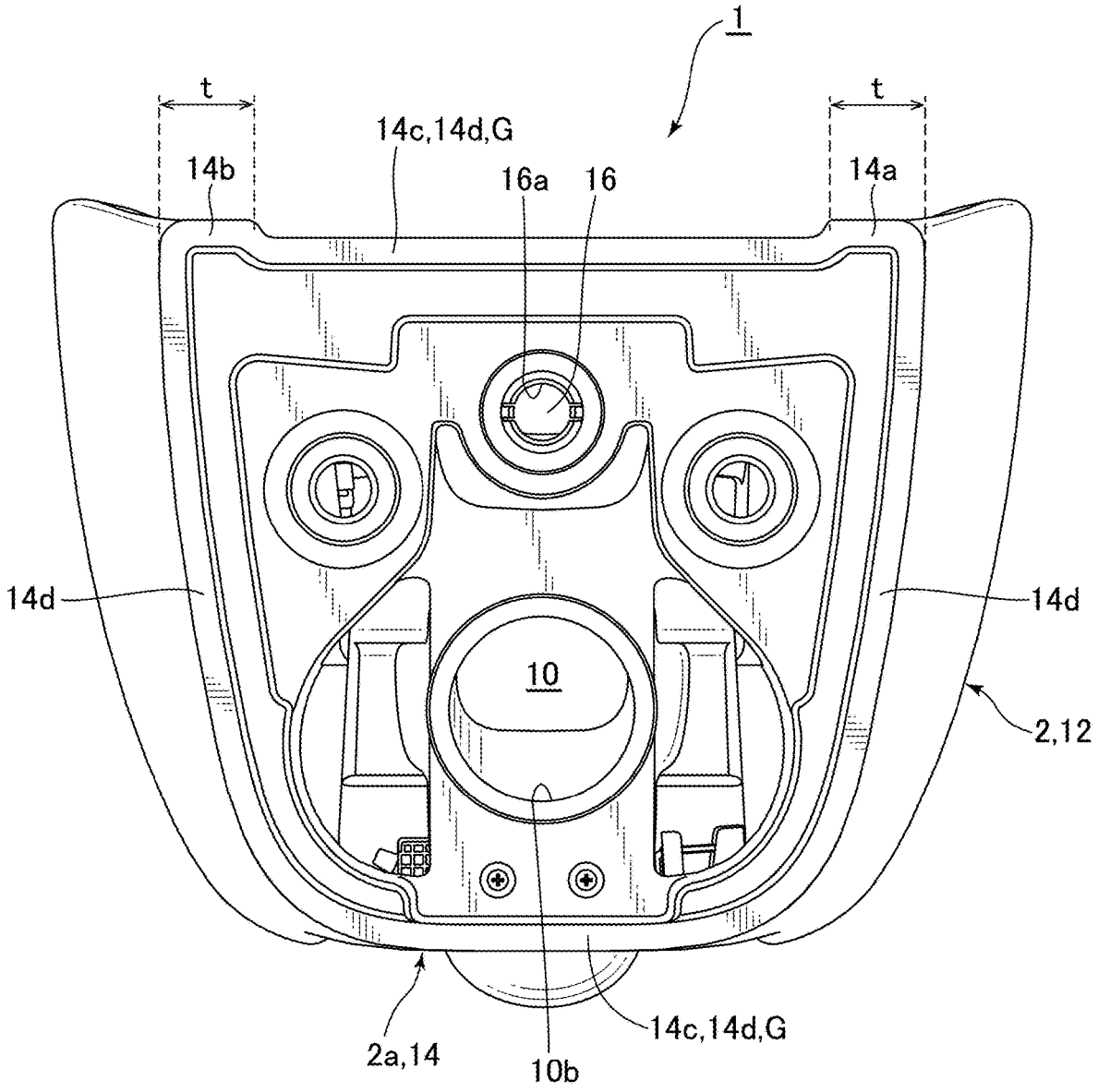
FIG. 5 is a back view of a ceramic toilet main body in the wall-mounted flush toilet according to the embodiment of the present invention.
Figure 6:
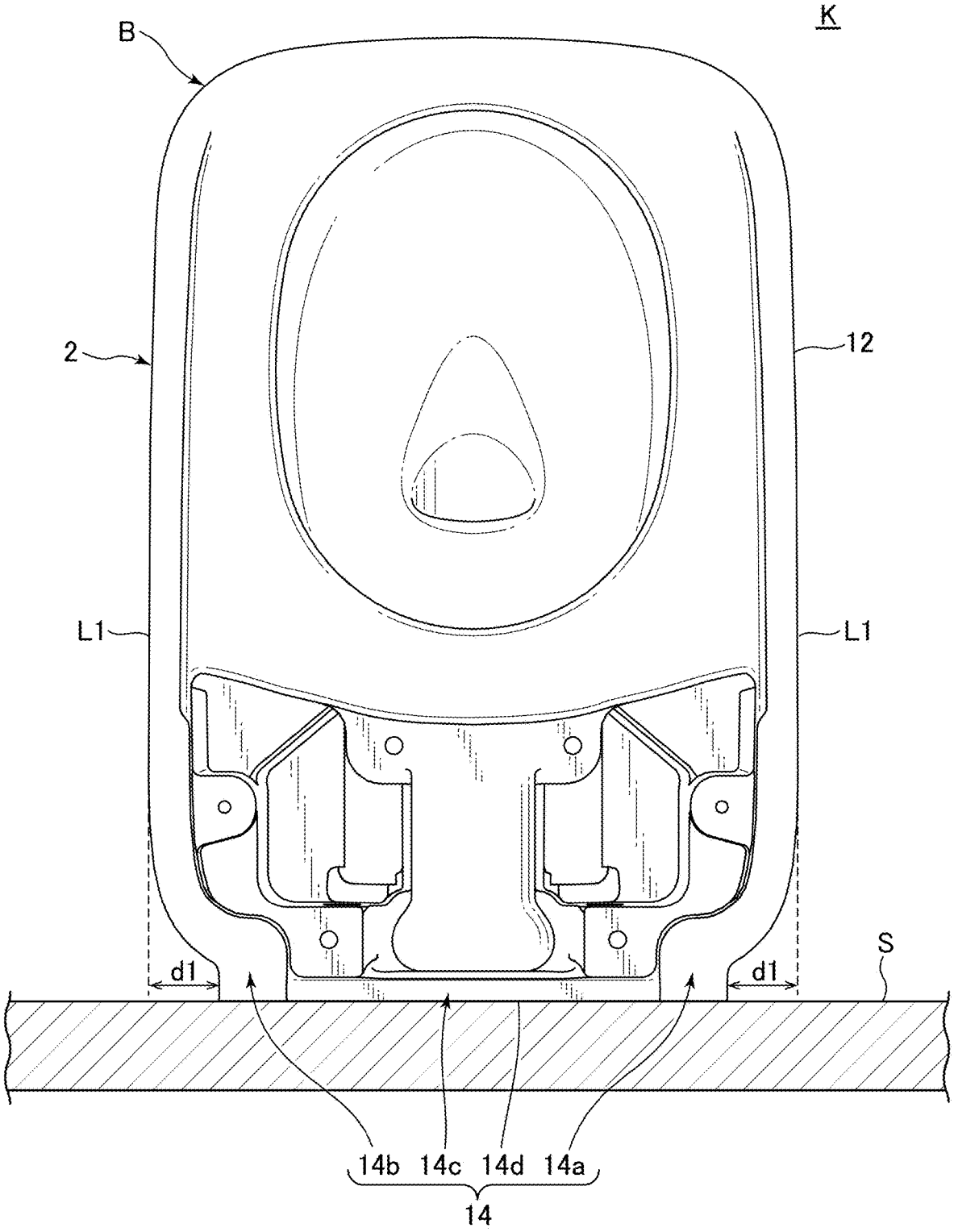
FIG. 6 is a front view showing a state where the ceramic toilet main body is grounded during a firing process of the wall-mounted flush toilet according to the embodiment of the present invention.
Figure 7:
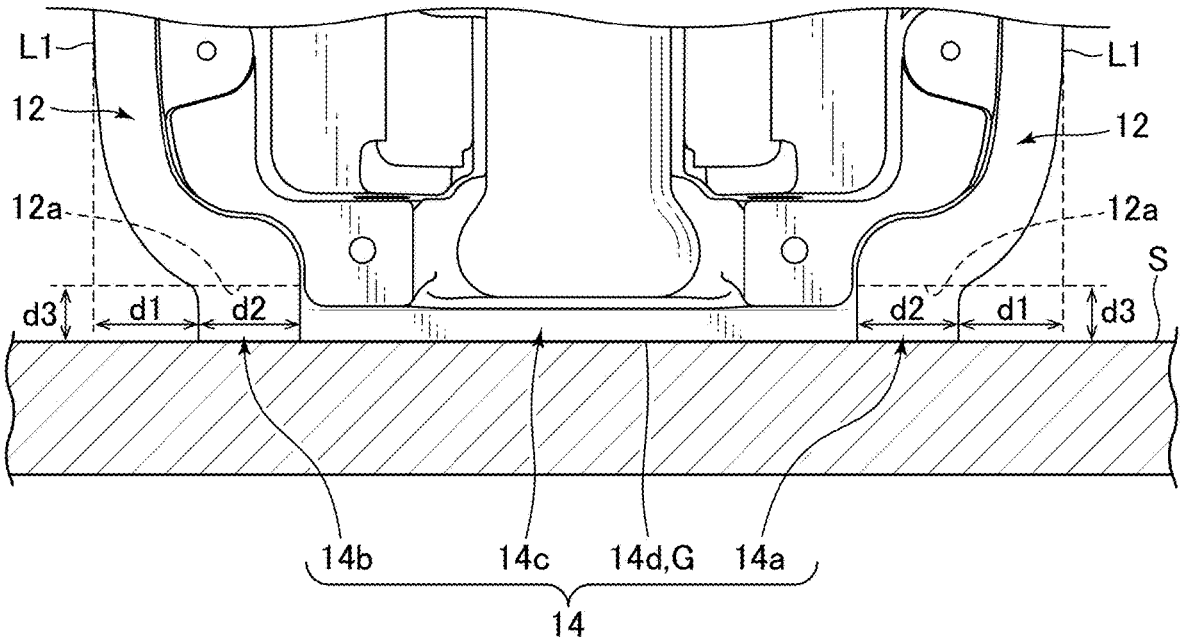
FIG. 7 is a partially enlarged view obtained by partially enlarging a firing pedestal of the ceramic toilet main body during the firing process of the wall-mounted flush toilet according to the embodiment of the present invention shown in FIG. 6.

Next, during the firing process, the rear end 2*a* of the toilet main body 2 in a state A of being fixed to the wall W within the toilet room T shown in FIG. 3 is grounded on a shelf surface or floor surface S within the kiln K, and thus disposed such that the front-rear direction of the toilet main body 2 in use corresponds to the vertical direction, as shown in FIGS. 6 and 7. Further, in planar view of the toilet main body 2 in the state A of being fixed to the wall W within the toilet room T shown in FIG. 3, and in front view of the toilet main body 2 in a state B of being grounded on the shelf surface or floor surface S within the kiln K during the firing process shown in FIGS. 6 and 7, the firing pedestal 14 is disposed a distance d1 (d1≥d0) equal to or more than a predetermined distance do inside an outer shell LI on each of right and left sides of the skirt 12 of the toilet main body 2. Here, the ceramic molding process of the ceramic toilet main body 2 in the flush toilet 1 of the present embodiment includes, for example, a process (pouring process) of pouring slurry into a molding mold made of a gypsum mold or the like, a process (slurry removal process) of removing excess slurry from inside the molded body after depositing the slurry on the molding mold, a process (soil tightening process) of reducing the water content of the molded body to improve shape retention and demoldability, a process (demolding process) of demolding the molded body, and the like. In the present embodiment, in particular, for molding (pouring molding) in the above-described pouring process, the pouring molding to mold the hollow molded body is defined as "single molding", and pouring molding to mold a molded body that does not have any hollow region (solid molded body) is defined as "double molding". Further, an intricately shaped portion in the ceramic toilet main body 2 of the flush toilet 1 according to the present embodiment is molded by appropriately combining single molding and double molding.

Figure 8:
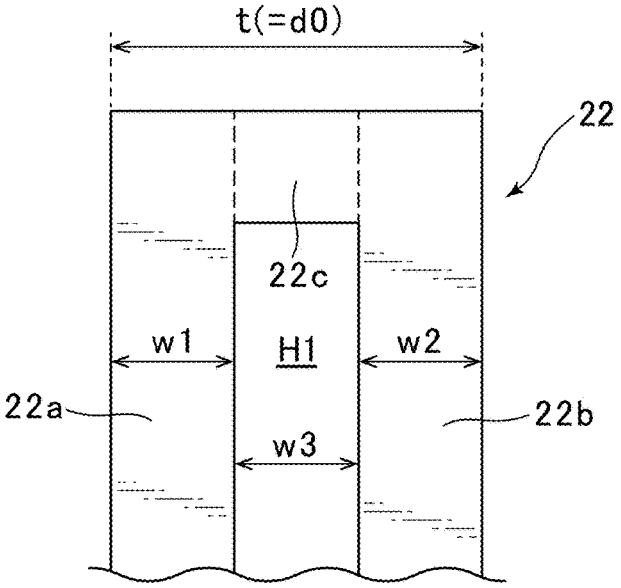
FIG. 8 is a schematic plan view showing an example of a representative hollow molded body molded (singly molded) during a ceramic molding process of the ceramic toilet main body in the wall-mounted flush toilet according to the embodiment of the present invention.

As shown in FIG. 8, a representative hollow molded body 22 molded (singly molded) during the ceramic molding process for the ceramic toilet main body 2 in the flush toilet 1 of the present embodiment includes, for example, a first wall 22*a* with a thickness w1 and a second wall 22*b* with a thickness w2 that are formed on opposite sides of a hollow region H1, and a connection wall 22*c* with a thickness w3 that connects both the walls 22*a* and 22*b*. Then, the predetermined distance do described above is set to a length of a thickness t (hereinafter defined as "single thickness t") that is a thickness (w1+w2+w3) obtained by adding up the wall thickness w1 of the first wall, the thickness w3 of the hollow region H1 (the thickness w3 of the connection wall 22*c*), and the thickness w2 of the second wall 22*b* (d0=t=w1+w2+w3). Additionally, as a specific typical example, dimensions relating to the single thickness t are preferably set as w1=w2=9 mm, w3=10 mm, and d0=t=w1+w2+w3=28 mm.

Next, as shown in FIGS. 3 and 5 to 7, the firing pedestal 14 includes a left firing pedestal part 14*a* and a right firing pedestal part 14*b* that are respectively provided on the left and right sides of the rear end 2*a* of the toilet main body 2 as the toilet main body 2 is viewed from front (user side), and a connection part 14*c* provided between the left firing pedestal part 14*a* and the right firing pedestal part 14*b* and connecting the left firing pedestal part 14*a* and the right firing pedestal part 14*b*. Further, a rear end 14*d* of the connection part 14*c* shown in FIG. 3 (the lower end 14*d* of the connection part 14*c* shown in FIG. 7) forms a ground contact surface G during the firing process, when the toilet main body 2 is grounded on the shelf surface or floor surface S within the kiln K during the firing process.

Next, in the planar view of the toilet main body 2 in the state A of being fixed to the wall W within the toilet room T shown in FIG. 3 and the front view of the toilet main body 2 in the state B of being grounded on the shelf surface or floor surface S within the kiln K during the firing process shown in FIGS. 6 and 7, the firing pedestal is formed such that each firing pedestal parts 14*a* and 14*b* has a dimension (distance d2) in the left-right direction equal to the dimension of the single thickness t (d2=t). In the present embodiment, the form of each of the firing pedestal parts 14*a* and 14*b* having the dimension (distance d2) in the left-right direction set to the dimension of the single thickness t is described, but is not limited to such a form, and it is preferable to set the dimension (distance d2) of at least one of the respective firing pedestal parts 14*a* and 14*b* in the left-right direction to be equal to or more than the dimension of the single thickness t.

Next, as shown in FIGS. 3 and 5 to 7, in the planar view of the toilet main body 2 in the state A of being fixed to the wall W within the toilet room T shown in FIG. 3 and the front view of the toilet main body 2 in the state B of being grounded on the shelf surface or floor surface S within the kiln K during the firing process shown in FIGS. 6 and 7, the firing pedestal is formed such that a dimension of each of the firing pedestal parts 14*a* and 14*b* in the front-rear direction, that is, a distance d3 from a front end of each of the firing pedestal parts 14*a* and 14*b* (the rear end 12*a* of the skirt 12) to the rear end 14*d* in the front-rear direction is a dimension smaller than the dimension of the single thickness t (d3<t). Further, as shown in FIGS. 3 and 5 to 7, the firing pedestal 14 is formed to have the rear end 14*d* of the connection part 14*c* shown in FIG. 3 (the lower end 14*d* of the connection part 14*c* shown in FIG. 7) formed in a flat surface.

According to the flush toilet 1 of the embodiment of the present invention described above, the rear end 2*a* formed rearward of the skirt 12 in the ceramic toilet main body 2 includes the firing pedestal 14 that functions as the pedestal grounded during the firing process in the ceramic molding process. Thereby, even if the firing pedestal 14 grounded during the firing process is deformed due to shrinkage or the like, dragged along the ground contact surface G grounded on the shelf surface or floor surface S within the kiln K and further deformed to cause dimensional variation, the firing pedestal 14 can absorb the dimensional variation in toilet main bodies 2. As compared with a toilet main body that does not include the firing pedestal 14 in the rear end 2*a*, a portion of the toilet main body 2 that is likely to deform can be limited to the firing pedestal 14, and a portion other than the firing pedestal 14 can be inhibited from being deformed. Therefore, it is possible to inhibit outer shapes of toilet main bodies 2 from being likely to vary and inhibit appearance of the flush toilet 1 from being affected.

According to the flush toilet 1 of the present embodiment, in the planar view of the toilet main body 2 in the state A of being fixed to the wall W within the toilet room T shown in FIG. 3 and the front view of the toilet main body 2 in the state B of being grounded on the shelf surface or floor surface S within the kiln K during the firing process shown in FIGS. 6 and 7, the firing pedestal 14 is disposed the distance d1 (d1≥d0=t) equal to or more than the predetermined distance do (dimension of the single thickness t) inside the outer shell LI on each of the left and right sides of the skirt 12. Even if deformation occurs as much as the dimension of the single thickness t due to the shrinkage or the like during the firing process, the firing pedestal 14 can sufficiently absorb the deformation. As compared with a toilet main body that does not include the firing pedestal 14, it is possible to effectively inhibit outer shapes of toilet main bodies 2 from being likely to vary, and it is therefore possible to effectively inhibit the appearance of the flush toilet 1 from being affected.

According to the flush toilet 1 of the present embodiment, in the planar view of the toilet main body 2 in the state A of being fixed to the wall W within the toilet room T shown in FIG. 3 and the front view of the toilet main body 2 in the state B of being grounded on the shelf surface or floor surface S within the kiln K during the firing process shown in FIGS. 6 and 7, the firing pedestal is formed such that each of the firing pedestal parts 14*a* and 14*b* has the dimension (distance d2) in the left-right direction equal to the dimension of the single thickness t (d2=t). Therefore, the entire firing pedestal 14 of the toilet main body 2 can acquire sufficient strength.

According to the flush toilet 1 of the present embodiment, in the planar view of the toilet main body 2 in the state A of being fixed to the wall W within the toilet room T shown in FIG. 3 and the front view of the toilet main body 2 in the state B of being grounded on the shelf surface or floor surface S within the kiln K during the firing process shown in FIGS. 6 and 7, the firing pedestal is formed such that the dimension of each of the firing pedestal parts 14*a* and 14*b* in the front-rear direction, that is, the distance d3 from the front end of each of the firing pedestal parts 14*a* and 14*b* (the rear end 12*a* of the skirt 12) to the rear end 14*d* in the front-rear direction is the dimension smaller than the dimension of the single thickness t (d3<t). Thereby, a largely deformed portion of the firing pedestal 14 that is in contact with the ground contact surface (the shelf surface or floor surface S within the kiln K) during the firing process can be reduced to a comparatively small dimension. Therefore, it is possible to inhibit the toilet main body from being affected by the deformation such as shrinkage or the like in the firing pedestal 14 during the firing process.

According to the flush toilet 1 of the present embodiment, the firing pedestal 14 is formed to have the rear end 14*d* of the connection part 14*c* of the firing pedestal shown in FIG. 3 (the lower end 14*d* of the connection part 14*c* shown in FIG. 7) formed in the flat surface. Thereby, when the rear end 14*d* of the connection part 14*c* shown in FIG. 3 in the firing pedestal 14 (the lower end 14*d* of the connection part 14*c* shown in FIG. 7) is grounded on the shelf surface or floor surface S within the kiln K during the firing process, the flat surface of the rear end 14*d* of the connection part 14*c* shown in FIG. 3 in the firing pedestal 14 (the lower end 14*d* of the connection part 14*c* shown in FIG. 7) can be grounded to stably support the weight of the entire toilet main body 2.

According to the flush toilet 1 of the present embodiment, the rear end 14*d* of the connection part 14*c* shown in FIG. 3 connecting the left firing pedestal part 14*a* and the right firing pedestal part 14*b* in the firing pedestal 14 (the lower end 14*d* of the connection part 14*c* shown in FIG. 7) forms the ground contact surface G when the toilet main body 2 is grounded on the shelf surface or floor surface S within the kiln K during the firing process. Thereby, when the rear end 14*d* of the connection part 14*c* shown in FIG. 3 (the lower end 14*d* of the connection part 14*c* shown in FIG. 7) in the firing pedestal 14 is grounded on the shelf surface or floor surface S within the kiln K during the firing process, the ground contact surface G of the connection part 14*c* of the firing pedestal 14 can stably support the weight of the entire toilet main body 2, and the toilet main body 2 can have strength further improved.

Although the present disclosure has been explained with reference to specific, preferred embodiments, one of ordinary skill in the art will recognize that modifications and improvements can be made while remaining within the scope and spirit of the present disclosure. The scope of the present disclosure is determined solely by appended claims.

What is claimed is:

1. A wall-mounted flush toilet comprising:

a ceramic toilet main body including a bowl configured to receive waste; and a discharge trap including an inlet connected to a lower part of the bowl and configured to discharge waste from within the bowl, wherein the ceramic toilet main body further includes a skirt that at least partially covers outer shells of the bowl and the discharge trap from sides of the outer shells; and a rear end formed rearward of the skirt and configured to be fixed to the wall, and the rear end includes a firing pedestal that functions as a pedestal grounded during a firing process in a ceramic molding process, and wherein the firing pedestal is disposed at a predetermined distance or more inside an outer shell on each of left and right sides of the skirt in planar view of the toilet main body, the ceramic molding process includes a process of pouring slurry into a molding mold and then demolding to mold a hollow molded body, the molded body includes a first wall and a second wall that are formed on opposite sides of a hollow region of the molded body, and the predetermined distance is set to a dimension of a single thickness that is a thickness obtained by adding up a wall thickness of the first wall, a thickness of the hollow region, and a wall thickness of the second wall.

2. The wall-mounted flush toilet according to claim 1, wherein the firing pedestal is formed such that at least a part of the firing pedestal has a dimension in a left-right direction equal to the dimension of the single thickness in the planar view of the toilet main body.

3. The wall-mounted flush toilet according to claim 1, wherein the firing pedestal is formed in a dimension in a front-rear direction that is smaller than the dimension of the single thickness in the planar view of the toilet main body.

4. The wall-mounted flush toilet according to claim 1, wherein the firing pedestal is formed to have a rear end formed in a flat surface.

5. The wall-mounted flush toilet according to claim 1, wherein the firing pedestal includes a left firing pedestal part provided on a left side of the rear end of the toilet main body in a left-right direction, a right firing pedestal part provided on a right side of the rear end of the toilet main body in the left-right direction, and a connection part provided between the left firing pedestal part and the right firing pedestal part and connecting the left firing pedestal part and the right firing pedestal part, and the connection part includes a ground contact surface when the toilet main body is grounded during the firing process.

6. A wall-mounted flush toilet comprising:

a ceramic toilet main body including a bowl configured to receive waste; and a discharge trap including an inlet connected to a lower part of the bowl and configured to discharge waste from within the bowl, wherein the ceramic toilet main body further includes a skirt that at least partially covers outer shells of the bowl and the discharge trap from sides of the outer shells; and a rear end formed rearward of the skirt and configured to be fixed to the wall, and the rear end includes a firing pedestal that functions as a pedestal grounded during a firing process in a ceramic molding process, and wherein the firing pedestal is disposed at a distance equal to or more than a predetermined distance inside an outer shell on each of right and left sides of the skirt, and a side surface of the firing pedestal forms a smooth curved surface from a top to a bottom of the firing pedestal.

7. A wall-mounted flush toilet comprising:

a ceramic toilet main body including a bowl configured to receive waste; and a discharge trap including an inlet connected to a lower part of the bowl and configured to discharge waste from within the bowl, wherein the ceramic toilet main body further includes a skirt that at least partially covers outer shells of the bowl and the discharge trap from sides of the outer shells; and a rear end formed rearward of the skirt and configured to be fixed to the wall, and the rear end includes a firing pedestal that functions as a pedestal grounded during a firing process in a ceramic molding process, and wherein the firing pedestal is disposed at a distance equal to or more than a predetermined distance inside an outer shell on each of right and left sides of the skirt, and an upper end of a rear end of the firing pedestal in a side view is located lower than a topmost of the toilet main body.

* * * * *